United States Patent [19]

Yee

[11] Patent Number: 4,627,212

[45] Date of Patent: Dec. 9, 1986

[54] SPLICE SLEEVE FOR REINFORCING BARS WITH CYLINDRICAL SHELL

[75] Inventor: Alfred A. Yee, Honolulu, Hi.

[73] Assignee: Hysao Miyamoto, Tokyo, Japan

[21] Appl. No.: 764,063

[22] Filed: Aug. 9, 1985

[51] Int. Cl.[4] ..... F16B 7/00

[52] U.S. Cl. ..... 52/726; 52/230; 285/292; 403/314

[58] Field of Search ..... 52/230, 232, 720, 722, 52/726; 285/292, 294; 403/265, 314

[56] References Cited

U.S. PATENT DOCUMENTS

| | | | |
|---|---|---|---|
| 277,778 | 5/1883 | Phelps . | |
| 518,793 | 4/1894 | Smith . | |
| 1,251,464 | 1/1918 | Becker . | |
| 1,689,281 | 10/1928 | Forssell | 403/265 |
| 2,251,189 | 7/1941 | Jensen . | |
| 3,033,600 | 5/1962 | Drysdale . | |
| 3,540,763 | 11/1970 | Yee | 52/232 X |
| 3,552,787 | 1/1971 | Yee | 403/265 |
| 3,667,782 | 6/1972 | Viazzi . | |
| 4,114,344 | 9/1978 | Heasman | 52/726 X |
| 4,143,986 | 3/1979 | Antosh | 52/726 X |
| 4,165,104 | 8/1979 | van den Beld | 285/292 |
| 4,226,444 | 10/1980 | Bunyan | 285/294 X |
| 4,441,837 | 4/1984 | Mastroni | 403/314 X |
| 4,525,916 | 7/1985 | Wührer | 403/314 X |

FOREIGN PATENT DOCUMENTS

| | | | |
|---|---|---|---|
| 100892 | 9/1925 | Austria | 403/314 |
| 34919 | 4/1886 | Fed. Rep. of Germany | 403/314 |
| 548751 | 4/1932 | Fed. Rep. of Germany | 403/314 |
| 2422747 | 11/1974 | Fed. Rep. of Germany | 403/265 |
| 464026 | 1/1914 | France | 403/314 |
| 584478 | 10/1958 | Italy | 403/314 |

*Primary Examiner*—J. Karl Bell

*Attorney, Agent, or Firm*—Harvey B. Jacobson

[57] ABSTRACT

A splice sleeve for receiving and connecting adjoining ends of a pair of reinforcing bars or rods in which the sleeve includes a rigid shell having a cylindrical external surface and an internal surface with ridges constructed to provide a wedging action and compression of grouting introduced into the shell. In one embodiment, the shell includes an internal surface which tapers inwardly toward the ends of the shell. In another embodiment, the shell has a cylindrical internal surface with ridges which increase in height from the centermost ridges to the outer ridges. In a further embodiment, the shell has a cylindrical external and internal surface for approximately one-half of its length with the other half of its length being smoothly tapered and provided with external longitudinal flanges and both end portions of the shell have internal ridges with the ridges in the cylindrical portion progressively increasing in radial extent from the inner ridge to the outer ridge and the ridges in the tapering portion of the shell being of constant radial extent. In a still further embodiment, the shell is substantially cylindrical throughout it length with only one tip end portion of the shell being sharply tapered inwardly with the wall thickness of the shell being constant and the ridges being constructed to provide a wedging and compression action at each end of the sleeve.

3 Claims, 10 Drawing Figures

SPLICE SLEEVE FOR REINFORCING BARS WITH CYLINDRICAL SHELL

BACKGROUND OF THE INVENTION

1. Field of the Invention

This invention relates to a splice sleeve for reinforcing bars utilized in concrete wall structures or columns and more particularly to a splice sleeve having a longitudinally elongated shell provided with a cylindrical external surface to enable a sleeve of less diameter to be utilized for application in thinner concrete walls. Also, the less diameter sleeves contribute to an increase in the core ratio of columns and therefore the cross-sectional area of the columns can be comparatively reduced at structural design. The interior surface of the sleeve is provided with annular ridges with the annular space between the interior of the sleeve and the exterior of the reinforcing bars being filled with grouting with the ribs on the bars and the ridges on the sleeve interlocking the bars with the sleeve for fixedly connecting and generally aligning the ends of the reinforcing bars. In one embodiment of the invention, the shell of the sleeve has interior surfaces which taper toward the outer ends with all of the ridges being of the same height in relation to the internal surface whereby the tapered internal surfaces produce a wedging or compression action with respect to the grouting and reinforcing bars. In another embodiment of the invention, the internal surface of the shell is cylindrical and the internal ridges increase in height from the center of the shell toward the outer end to provide the desired wedging or compression action with respect to the grouting thereby fixedly interlocking the shell, grouting and reinforcing bars. In further embodiments of the invention, the sleeve is provided with a wedging action at only one end thereof with the sleeve having a smoothly tapering internal and external surface with the internal surface having ribs of constant height and the external surface having reinforcing flanges or ridges having an external edge forming a continuation of the cylindrical surface of the remainder of the sleeve or the end of the sleeve may be sharply tapered and the remainder of the sleeve being cylindrical both on the internal and external surface with the ridges on the internal surface progressively increasing in height.

My prior U.S. Pat. No. 3,540,763 issued Nov. 17, 1970, discloses a splice sleeve and its utility in which the splice sleeve is double frustoconical in configuration with the thickness of the wall being constant and the external surfaces tapering from the center inwardly towards the outer ends. The prior art cited by the Patent Office during prosecution of the application which matured into U.S. Pat. No. 3,540,763, and the following U.S. patents are relevant to this invention:

| | |
|---|---|
| 277,778 | May 15, 1884 |
| 518,793 | Apr. 14, 1894 |
| 1,251,646 | Jan. 1, 1918 |
| 2,251,189 | July 29, 1941 |
| 3,033,600 | May 8, 1962 |
| 3,667,782 | June 6, 1972 |

SUMMARY OF THE INVENTION

An object of the present invention is to provide a splice sleeve for connecting the ends of generally aligned reinforcing bars with the sleeve having a generally cylindrical external surface on the shell to enable the sleeve to be formed with a smaller external diameter for use in thinner concrete walls and in columns having less cross-sectional area.

Another object of the invention is to provide a splice sleeve in accordance with the preceding object in which the internal surface of the cylindrical shell has end portions which taper inwardly and longitudinally toward the outer ends of the shell with the internal surface also including annular ridges of substantially equal height spaced throughout the length of the internal surface to cooperate with the ribs on the reinforcing bars and grouting filling the space between the reinforcing bars and the internal surface of the shell to rigidly secure the reinforcing bars, grouting and shell into a fixedly interconnected unit.

A further object of the invention is to provide a splice sleeve having a cylindrical external surface and a cylindrical internal surface with a plurality of longitudinally spaced, annular ridges oriented throughout the length of the internal surface of the sleeve and constructing the ridges with greater height toward the outer ends of the sleeve to produce a wedging or compression action to securely bond the reinforcing bars, grouting and sleeve into a fixed unit.

Still another object of the invention is to provide a splice sleeve for reinforcing bars in accordance with the preceding objects in which the shell is provided with ports adjacent the ends thereof with one port being smaller than the other to enable the interior of the shell to be filled completely with grouting so that the entire annular space between the exterior of the reinforcing bars and the interior of the shell will be filled with grouting.

Yet another object of the invention is to provide a splice sleeve having a cylindrical surface over at least one-half of its length with one end portion of the sleeve having either a gradually tapering internal and external surface or a cylindrical surface terminating in a relatively short frusto-conical portion with inwardly tapering internal and external surfaces.

A still further object of the invention is to provide a splice sleeve in accordance with the preceding objects which is simple to use, effective for connecting the ends of reinforcing bars and capable of being used in thinner reinforced concrete wall structures.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
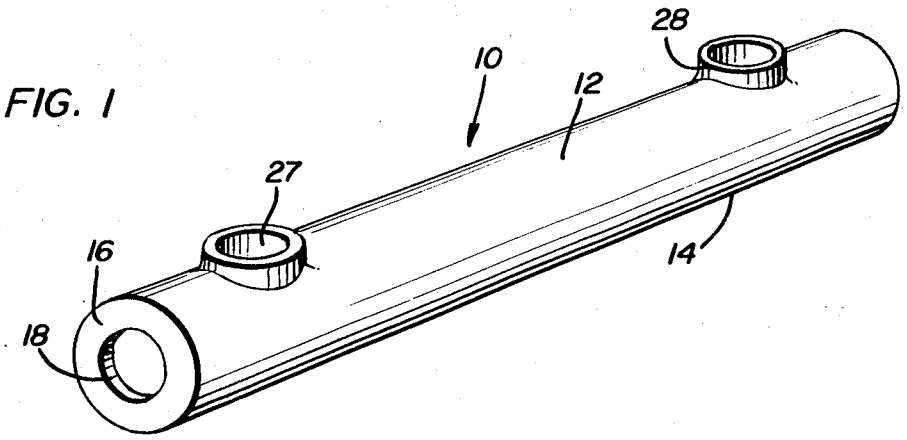
FIG. 1 is a perspective view of the splice sleeve of this invention.
Figure 2:
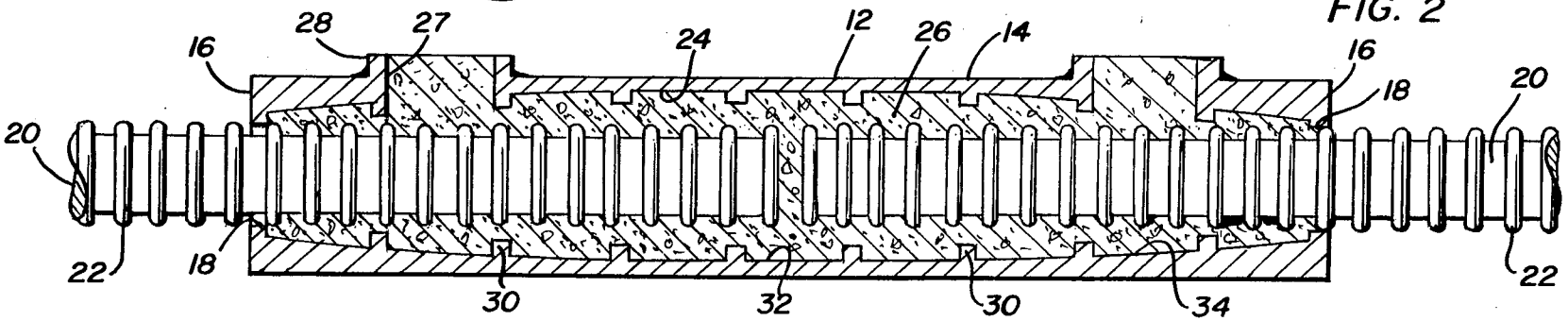
FIG. 2 is a longitudinal, sectional view, on an enlarged scale, illustrating the structure and association of the splice sleeve with the reinforcing bars and grouting.

Referring now specifically to the drawings, the splice sleeve of the present invention illustrated in FIGS. 1 and 2 is generally designated by numeral 10 and includes a one-piece shell 12 constructed of metal, such as cast steel or the like with the shell 12 including a cylindrical external surface 14 having the same diameter substantially throughout its length and end surfaces 16 perpendicular thereto. The end surfaces 16 of the shell 12 are each provided with an opening or aperture 18 centrally located therein for receiving the end portion of reinforcing bars 20 which includes external annular ribs or ridges 22 with the reinforcing bars 20 being of conventional construction. The reinforcing bars 20 are inserted into the shell 12 until the inner ends thereof are in closely spaced or abutting engagement. The internal surface 24 of the shell is spaced from the reinforcing bars 20 and the annular space between the internal surface 24 and the reinforcing bars 20 is completely filled with grouting 26 which is inserted into the cylindrical shell 12 through grouting ports 27 which are defined by short projecting bosses 28 on the exterior of the shell 12 with one of the ports 27 being smaller in diameter so that grouting entering the larger port will completely fill the cavity due to the restricted discharge.

As illustrated, the internal surface 24 of the shell 12 includes a plurality of substantially equally spaced annular ridges 30 which are all of equal height or radial dimension from the internal surface. The central portion of the internal surface and a portion of the internal surface on each side of the central portion is cylindrical as at 32. However, the portion of the internal surface outwardly of the cylindrical central portion 32 inclines inwardly or tapers inwardly as at 34 so that the end portions of the internal surface 24 are of lesser diameter than the central portion which is cylindrical as at 32 so that, in effect, there is provided a double tapered or frustoconical end portions with a center portion being cylindrical along the internal surface of the shell 12. This tapering of the internal surface at 34 produces a wedging or compression action which together with the annular ridges 30 and the ribs 22 on the reinforcing bars 20 provide a very secure and rigid bond and interaction between the grout 26, the reinforcing bars 20 and the cylindrical shell 12 of the splice sleeve 10.

Figure 3:
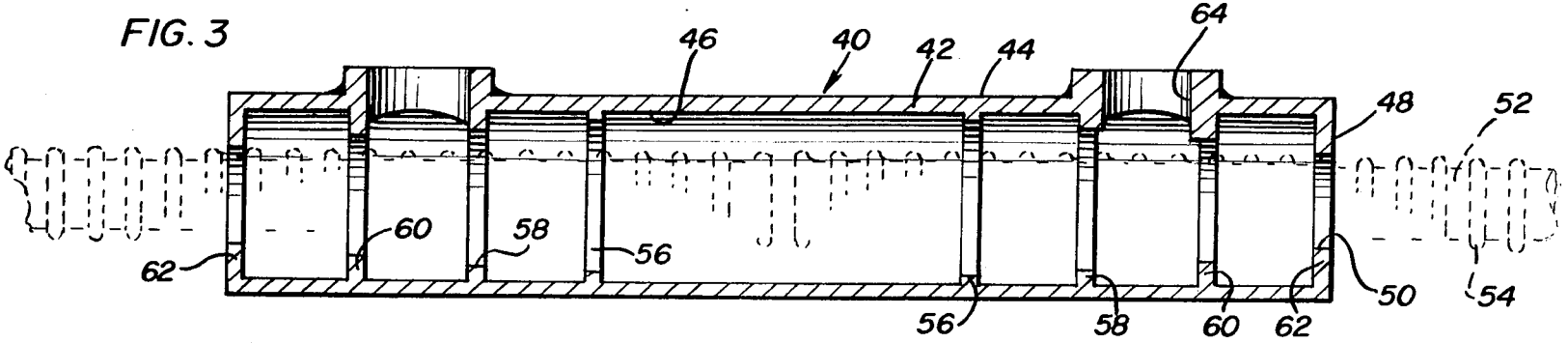
FIG. 3 is a longitudinal, sectional view of a second embodiment of the invention illustrating the structure thereof and the association of reinforcing bars therewith with the grouting omitted.
Figure 4:
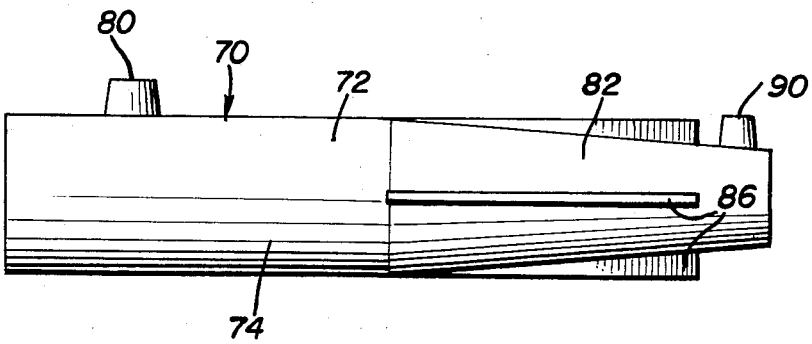
FIG. 4 is an elevational view of a another embodiment of the invention in which the sleeve tapers at only one end.
Figure 5:
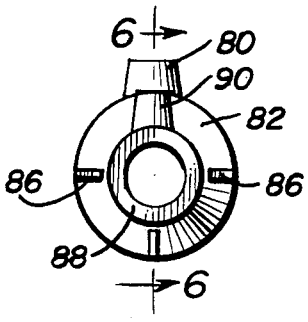
FIG. 5 is an end view of the construction of FIG. 4 as observed from the smaller end.
Figure 6:
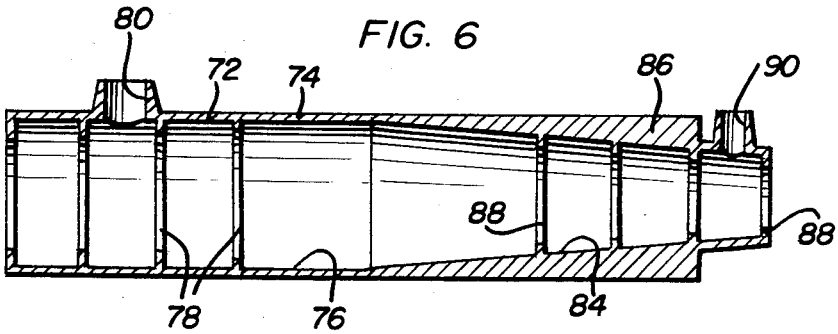
FIG. 6 is a longitudinal sectional view of the structure illustrated in FIG. 4.
Figure 7:
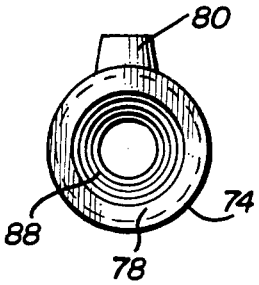
FIG. 7 is an end elevational view of FIG. 4 as observed from the larger end thereof.

FIG. 3 illustrates another embodiment of the splice sleeve of this invention designated by numeral 40 and which includes a shell 42 having a cylindrical external surface 44 and a cylindrical internal surface 46 with both surfaces having a constant diameter throughout their length. The end of the sleeve is provided with end surfaces 48 perpendicular to the cylindrical surfaces 44 and 46 with the end surfaces including an opening or aperture 50 for receiving an end portion of a reinforcing bar 52 having ribs or ridges 54 thereon in a conventional and well known manner.

The internal surface 46 of the shell 44 is provided with a plurality of longitudinally spaced, inwardly extending ridges 56, 58, 60 and 62 with the outermost ridges 62 being in the form of flanges defining the end surfaces 48 having the opening 50 therein. As illustrated, the ridges 56–62 increase in height or increase in their radial inward extension from the innermost ridge 56 toward the outermost ridge 62 thus, in effect, defining a frusto-conical surface if a line is extending through the inner edge surfaces of the ridges 56–62. The cylindrical shell 44 is also provided with grout holes 64 for introducing grouting between the internal surface 46 of the shell 44 and the reinforcing bars 52 with the progressive increase in height of the ridges 56–62 producing the wedging action or compression between the internal surface 46, the grouting and the reinforcing bars 52 thereby producing a secure fixed relationship between the shell 44, the grouting and the reinforcing bars 52 to provide a secure bonding and interaction between the splice sleeve and the reinforcing bars. It is pointed out that the number and spacing of the ridges 56–62 may vary but all of the ridges have a center oriented along the center of the internal surface 46 with the center of the opening 50 also being on the center of the shell 44 so that the reinforcing bars 52 are generally aligned when inserted into the splice sleeve 40.

By using the cylindrical external surface and either the tapering internal surface in FIG. 2 or the cylindrical internal surface with the progressively greater radial dimension of the ridges 56–60 in FIG. 3, a splice sleeve of less overall diameter can be used to effectively connect the reinforcing bars thereby enabling the splice sleeves to be constructed with less total cross-sectional area throughout their length thereby enabling the use of such splice sleeves in thinner reinforced concrete walls as compared with a splice sleeve having an external surface with a large central diameter as compared to the end diameters as illustrated in my prior U.S. Pat. No. 3,540,763. Also, the grouting used is the same as disclosed in the above-mentioned patent with the grouting being inserted after the reinforcing bars have been inserted into the sleeve. After the grouting expands and hardens into intimate contact with the ridges or grooves formed on the exterior of the reinforcing bars and the ridges or grooves formed on the inner surface of the sleeve, there is a positive locking engagement between the splice sleeve, the grouting and reinforcing bars. Forces exerted on the reinforcing bars to move them longitudinally outwardly after the grouting has hardened is more effectively resisted due to the wedge shaped action of the inwardly tapering internal surface in the FIG. 2 embodiment of the sleeve and by the progressive increase in height or radial dimension of the ridges 56–62 in the FIG. 3 embodiment of the sleeve. This provides a wedging action or compression action with respect to the grouting and this construction provides a positive wedge-like retainment of the grout encased ends of the reinforcing bars in the splice sleeve with the manner of use being further disclosed in the above-mentioned U.S. patent. This construction enables the splice sleeve to be used in concrete walls having less thickness as compared with the splice sleeve shown in the previously mentioned patent and the smaller diameter sleeves contributes to an increase in the core ratio of concrete columns thereby enabling the columns to be provided with a reduced cross-sectional area when designing the columns.

FIGS. 4–7 illustrate another embodiment of the splice sleeve 70 which includes a one-piece shell 72 having substantially one-half of its length provided with a cylindrical external surface 74 and a cylindrical internal surface 76 provided with a plurality of internal ridges 78 which progressively increase in radial height from the innermost ridge to the outermost one with a grouting port 80 being provided adjacent the end of the shell 72 having the ridge 78 extending radially inwardly to the greatest extent. The other end portion of the shell 72 has a smoothly and gradually tapering external surface 82 and internal surface 84 with the external surface including integral longitudinal flanges 86 having outer edges which form a continuation of the cylindrical external surface 74 of the shell 72 with the wall thickness of the tapering portion 82 of the shell 72 having a constant wall thickness and the internal surface 84 being provided with a plurality of ridges 88 which are of constant height. A grouting port 90 is provided in the end portion of the tapering portion 82 of the shell 72 with the flanges 86 terminating inwardly of the grouting port 90 which is of less diameter than the grouting port 80 so that grouting inserted into the shell 72 through the port 80 will completely fill the space between the reinforcing bars and the sleeve 70 due to the flow restriction and pressure build-up of the grouting internally of shell 72. In this embodiment, the sleeve 70 has a single frustoconical end portion with the thickness of the wall being constant and the external and internal surfaces tapering from the center inwardly toward one end with the plurality of flanges 86 being of the same height as the external surface of the sleeve at the center and the internal surface of the tapering portion of the sleeve has equally spaced annular ridges which are of equal height or radial dimension from the internal surface.

Figure 8:
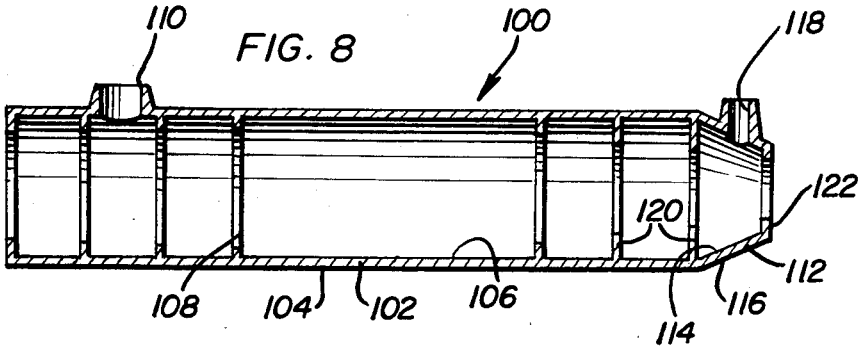
FIG. 8 is a longitudinal sectional view of another embodiment of the invention in which the sleeve is cylindrical substantially throughout its length with a frusto-conical end portion.
Figure 9:
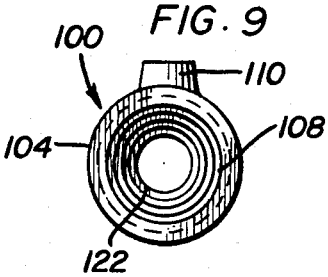
FIG. 9 is an end elevational view of the construction of FIG. 8 taken from the larger end thereof.
Figure 10:
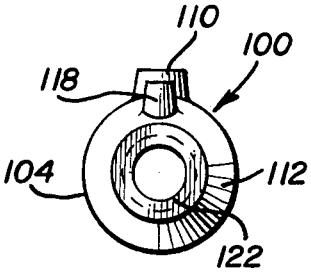
FIG. 10 is an end elevational view of the construction of FIG. 8 taken from the smaller end thereof.

FIGS. 8–10 illustrate a further embodiment of the splice sleeve generally designated by numeral 100 and includes a one-piece shell 102 having a cylindrical external surface 104 and a cylindrical internal surface 106 over a major portion of its length with the wall thickness of the shell 102 being constant throughout. One end of the shell 102 is provided with equally spaced internal ridges 108 which progressively increase in height toward the end thereof with an inlet port 110 being provided for grouting. The other end of the shell 102 includes a sharply tapering frusto-conical end portion 112 having an inwardly tapering inner surface 114 and an inwardly tapering outer surface 116 having a grouting port 118 communicated therewith which is smaller in diameter than the port 110. The internal surface of the cylindrical portion of the shell 102 where it joins with the tapering portion 112 is provided with internal ridges 120 which progressively increase in height and the tip end of the tapering or frusto-conical portion 112 is provided with a similar ridge 122 which cooperates with the ridges 120 to provide a progressive decrease in effective diameter of the ridges from the innermost ridge 120 to the end ridge 122 to provide the wedging action previously described when the shell 102 is filled with grouting and the ends of the reinforcing bars are therefore locked to the sleeve in the manner set forth.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A splice sleeve for connecting reinforcing bars in reinforced concrete construction comprising an elongated shell of one-piece construction, said shell including substantially constant diameter internal and external cylindrical surfaces and end surfaces having an opening receiving the end portions of reinforcing bars to be connected, said internal surface of the shell including a plurality of longitudinally spaced, inwardly extending annular ridges spaced from the exterior of the reinforcing bars inserted into the shell, said internal surface and ridges constructed in a manner to provide a wedging action and radial inward compression for grouting material inserted into the annular space between the reinforcing bars and internal surface of the shell thereby locking the shell, grouting and reinforcing bars fixedly throughout their length whereby the external cylindrical configuration of the shell enables a splice sleeve to be utilized with a smaller external diameter for a given diameter of reinforcing bars thereby enabling the splice sleeve to be utilized in thinner concrete wall structures and columns of less cross-sectional area, said internal surface of the sleeve being cylindrical throughout its length, said means providing a wedge action including said ridges progressively increasing in their inward radial dimension from the innermost ridges toward the outermost ridges thereby providing a wedging action and compression of grouting introduced into the shell, the outermost end ridges on the internal surface defining end flanges with a central opening receiving the reinforcing bars.

2. A splice sleeve for connecting adjacent ends of aligned reinforcing bars inserted into the ends of the sleeve, hardenable material filling the space between the interior of the sleeve and the ends of the reinforcing bars and means forming at least a portion of the interior of the sleeve to impart a wedging and compression action on the hardenable material to rigidly connect the sleeve, hardenable material and the ends of the reinforcing bars, said sleeve including substantially one-half of the length provided with a constant diameter cylindrical internal and external surface, the other substantially one-half of the length of the sleeve including a gradual inward taper, said means imparting a wedging and compression action including a plurality of equally spaced annular ridges on the cylindrical portion of the sleeve with the ridges extending inwardly a progressively greater radial extent from the innermost ridge to the outermost ridge, the tapering portion of the sleeve including a plurality of equally spaced internal annular ridges of equal height and ports of different cross-sectional area enabling the interior of the sleeve to be filled with hardenable material.

3. The sleeve as defined in claim 2 wherein said tapered portion of the sleeve includes a plurality of external longitudinally extending flanges, the outer edge of the flanges being straight and forming a continuation of the outer surface of the portion of the sleeve having a constant diameter external surface.

* * * * *